US005342271A

United States Patent [19]

Long

[11] Patent Number: 5,342,271

[45] Date of Patent: Aug. 30, 1994

[54] SOUND ABATING STACK PLATE SYSTEMS

[76] Inventor: Terry L. Long, 1722 Sturbridge Dr., Sewickley, Pa. 15143

[21] Appl. No.: 165,177

[22] Filed: Dec. 13, 1993

[51] Int. Cl.[5] ..... A63B 21/062

[52] U.S. Cl. ..... 482/98

[58] Field of Search ..... 482/93, 94, 97–103

[56] References Cited

U.S. PATENT DOCUMENTS

| | | | |
|---|---|---|---|
| 3,612,523 | 10/1971 | Glynn | 482/98 |
| 3,635,472 | 1/1972 | Marlyan | 482/101 |
| 3,708,166 | 1/1973 | Annas | 482/100 |
| 3,815,903 | 6/1974 | Blomqvist | 482/103 |
| 3,912,263 | 10/1975 | Yatso | 482/99 X |
| 3,971,555 | 7/1976 | Mahnke | 382/98 |
| 4,010,947 | 3/1977 | Lambert, Sr. | 482/98 |
| 4,111,414 | 9/1978 | Boberts | 482/102 X |
| 4,188,029 | 2/1980 | Brower et al. | 482/100 X |
| 4,200,280 | 4/1980 | Goodwin | 482/98 |
| 4,564,194 | 1/1986 | Dawson | 482/102 |
| 4,627,615 | 12/1986 | Norkowski | 482/98 |
| 4,744,560 | 5/1988 | Azari | 482/102 X |
| 4,878,662 | 11/1989 | Chern | 482/98 |
| 4,974,837 | 12/1990 | Someta et al. | 482/98 |
| 5,199,935 | 4/1993 | Gibson et al. | 482/98 |
| 5,256,122 | 10/1993 | Deder | 482/99 |

FOREIGN PATENT DOCUMENTS

| | | | |
|---|---|---|---|
| 2613237 | 10/1988 | France | 482/99 |

*Primary Examiner*—Robert Bahr

*Attorney, Agent, or Firm*—Michael J. Colitz, Jr.

[57] ABSTRACT

A system for abating noise associated with the use of weight stack plates comprising a stack of plates for a weight lifting machine, each plate having a central vertical hole therethrough and supplemental guide holds therethrough and a horizontal hole from one edge to the center vertical hole perpendicular to the central vertical hole elastomeric material operatively associated with at least the upper and lower surfaces of the plates of the stack to abate noise normally associated with the movement of the plates; and a pin positioned vertically through the center holes of the plates of the stack, the pin being formed of a plurality of axially aligned segments coupleable one to another, along a common axis with spacers associated with each segment corresponding to the thickness of the elastomeric material between adjacent plates, the pin being formed to have a horizontal hole in each segment aligned with the horizontal holes of the plates.

6 Claims, 4 Drawing Sheets

SOUND ABATING STACK PLATE SYSTEMS

BACKGROUND OF THE INVENTION

1. Field of the Invention

The present invention relates to sound abating stack plate systems and more particularly pertains to stack plate systems which are adapted to abate noise during the movement thereof.

2. Description of the Prior Art

The use of stack plates in weight lifting systems is known in the prior art. More specifically, stack plates heretofore devised and utilized for the purpose of physical therapy and weight lifting are known to consist basically of familiar, expected and obvious structural configurations, notwithstanding the myriad of designs encompassed by the crowded prior art which have been developed for the fulfillment of countless objectives and requirements.

Prior art weight stacks are disclosed for example in U.S. Pat. Nos. 4,856,773 to Deola; 4,949,958 to Richey; 4,974,839 to Cantor; 4,988,095 to Ferrari and 4,953,855 to Shields. Each of these systems is generally conventional in its approach to usage of weight stacks. Each makes a contribution to the prior art. None, however, is concerned with the abatement with noise associated with the movement of weights of a stack.

In this respect, the sound abating stack plate systems according to the present invention substantially depart from the conventional concepts and designs of the prior art, and in so doing provide an apparatus primarily developed for the purpose of reducing noise normally associated with their usage.

Therefore, it can be appreciated that there exists a continuing need for new and improved sound abating stack plate systems which can be used for noise abatement. In this regard, the present invention substantially fulfills this need.

SUMMARY OF THE INVENTION

In view of the foregoing disadvantages inherent in the known types of stack plate systems now present in the prior art, the present invention provides improved sound abating stack plate systems. As such, the general purpose of the present invention, which will be described subsequently in greater detail, is to provide a new and improved sound abating stack plate system apparatus and method which has all the advantages of the prior art stack plate systems and none of the disadvantages.

To attain this, the present invention essentially comprises a system for abating the noise normally associated with the use of weight stack plates comprising, in combination a stack of plates for a weight lifting machine, each plate having a central vertical hole therethrough and supplemental guide holds therethrough and a horizontal hole from one edge to the center vertical hole perpendicular to the central vertical hole for use in determining the number of plates to be lifted in a group a coil spring with a coating of elastomeric material to abate noise normally associated with the movement of the spring and weight stack plates, the spring being located beneath the lower most plate of the stack elastomeric means on at least the upper and lower surfaces of the plates of the stack to be lifted to abate noise normally associated with the movement of the plates a pin positioned vertically through the center holes of the plates of the stack, the pin being formed of a plurality of axially aligned segments coupleable one to another along a common axis alignment with a washer between each segment corresponding to the thickness of the elastomeric means between adjacent plates, the pin being formed to have a horizontal hole in each segment aligned with the horizontal holes of the plates; and a coupling member positionable through a predetermined horizontal hole in the pin and through an associated horizontal hole of a plate of the stack to determine which plates of the stack are to be lifted as a group.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved sound abating stack plate systems which have all the advantages of the prior art stack plate systems and none of the disadvantages.

It is another object of the present invention to provide new and improved sound abating stack plate systems which may be easily and efficiently manufactured and marketed.

It is a further object of the present invention to provide new and improved sound abating stack plate systems which are of a durable and reliable construction.

An even further object of the present invention is to provide new and improved sound abating stack plate systems which are susceptible of a low cost of manufacture with regard to both materials and labor, and which accordingly is then susceptible of low prices of sale to the consuming public, thereby making such sound abating stack plate systems economically available to the buying public.

Still yet another object of the present invention is to provide new and improved sound abating stack plate systems which provide in the apparatuses and methods of the prior art some of the advantages thereof, while simultaneously overcoming some of the disadvantages normally associated therewith.

Still another object of the present invention is to abate the noise normally associated with weight lifting.

Yet another object of the present invention is to render weight lifting less objectionable by reducing its associated noise.

Even still another object of the present invention is to provide a new and improved system for abating noise associated with the use of weight stack plates comprising a stack of plates for a weight lifting machine, each plate having a central vertical hole therethrough and supplemental guide holds therethrough and a horizontal hole from one edge to the center vertical hole perpendicular to the central vertical hole elastomeric material operatively associated with at least the upper and lower surfaces of the plates of the stack to abate noise normally associated with the movement of the plates; and a pin positioned vertically through the center holes of the plates of the stack, the pin being formed of a plurality of axially aligned segments coupleable one to another, along a common axis with spacers associated with each segment corresponding to the thickness of the elastomeric material between adjacent plates, the pin being formed to have a horizontal hole in each segment aligned with the horizontal holes of the plates.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
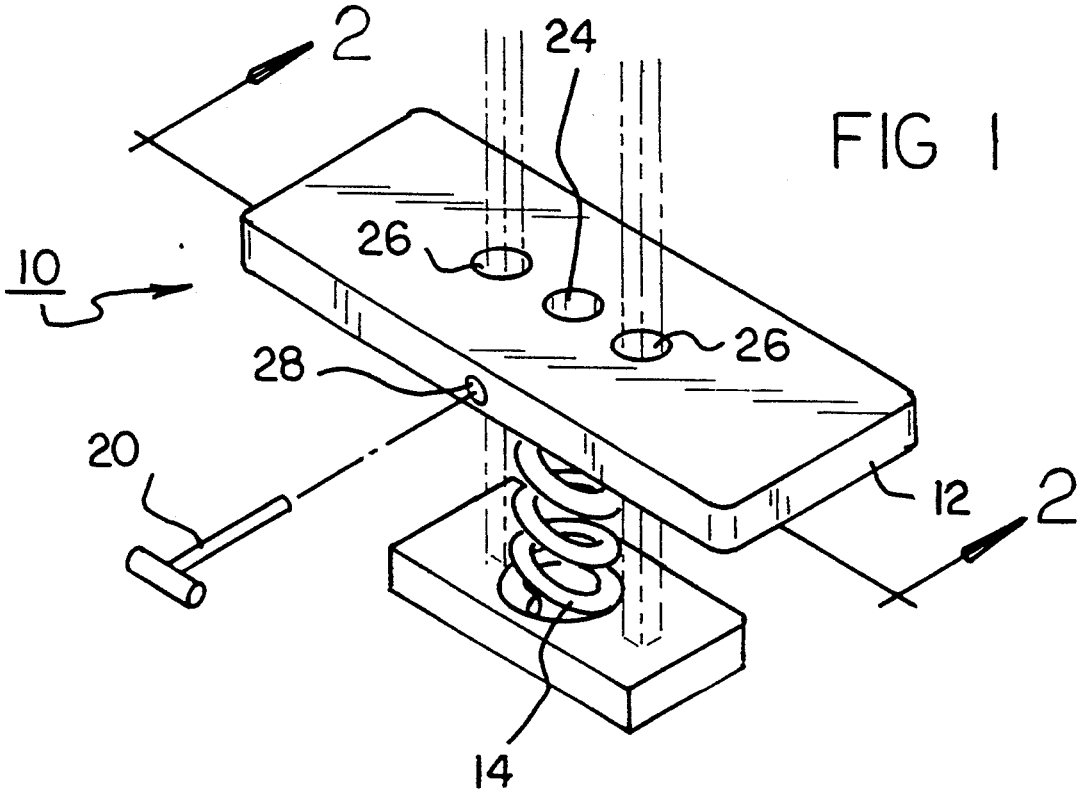
FIG. 1 is a perspective illustration of the lower weight of a stack constructed in accordance with the principles of the present invention.

With reference now to the drawings, and in particular to FIG. 1 thereof, a new and improved sound abating stack plate system embodying the principles and concepts of the present invention and generally designated by the reference numeral 10 will be described.

More specifically, it will be noted that the system 10 is for abating noise associated with weight stack plates. The system comprises, in combination, the plates 12, a spring 14, elastomeric material 16, a pin 18 and a coupling member 20.

The stack of plates 12 is for a weight lifting machine. Each plate 12 has a central vertical hole 24 therethrough and supplemental guide holds 26 therethrough. A horizontal hole 28, from one edge to the center vertical hole, perpendicular to the center vertical hole 24 is for use in determining the number of plates 12 to be lifted in a group.

A spring 14 is provided with a coating of elastomeric material 16. Such material functions to abate noise normally associated with the movement of the spring 14 and plates of the weight stack. The spring is located beneath the lower most plate of the stack.

The elastomeric material 16 is coated on at least the upper and lower surfaces of the plates of the stack to be lifted. Note FIG. 2. In the primary embodiment, the entire plate is so coated. Such coating is for functioning to abate the noise normally associated with the movement of the plates during their use.

Positioned vertically through the center holes of the plates of the stack is a pin 18. The pin 18 is being formed of a plurality of axially aligned segments 30. The segments are releasably, coupleable, one to another, by screw threads, couple one to another along a common axis. A washer 32 is positioned between each segment 30 corresponding to the thickness of the elastomeric material between adjacent plates 12. The pin is formed to have a horizontal hole 34 in each segment aligned with the horizontal holes 28 of the plates 12.

A coupling member in the form of a pin 20 is positionable through a predetermined horizontal hole 34 in the pin 18 and through an associated horizontal hole 28 of a plate of the stack. The selected plate 12 for pin 20 will determine which plates of the stack are to be lifted as a group.

Figure 2:
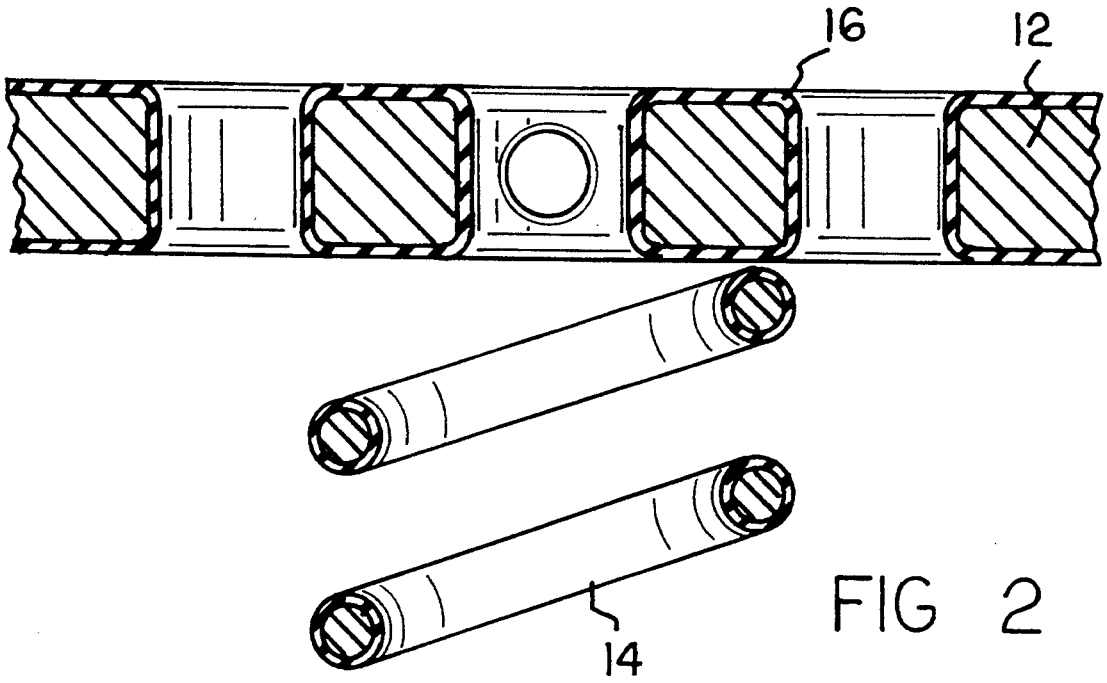
FIG. 2 is a sectional view of the apparatus as shown in FIG. 1 taken along line 2—2.
Figure 3:
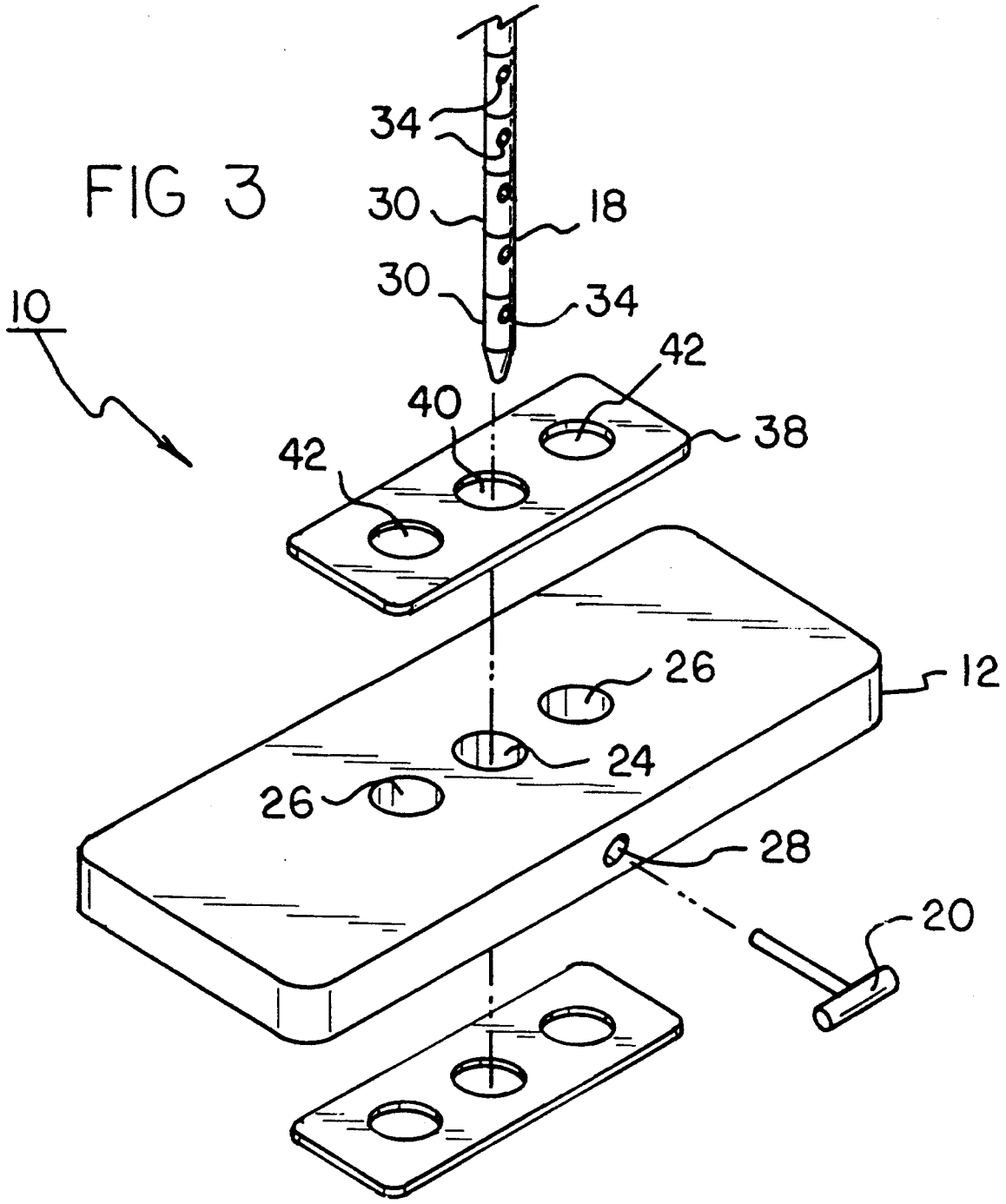
FIG. 3 is a perspective view of one weight of a stack plate system employing elastomeric noise abatement plates.
Figure 4:
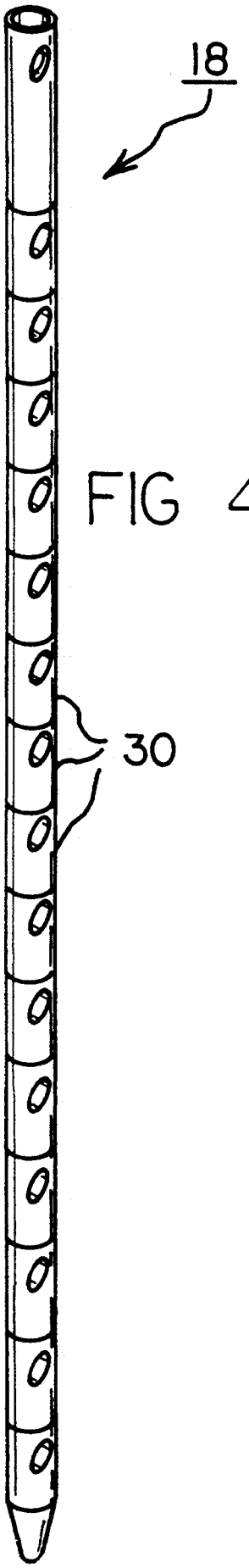
FIG. 4 is an enlarged perspective view of a pin usable in association with the weight stack constructed in accordance with the principles of the present invention.
Figure 5:
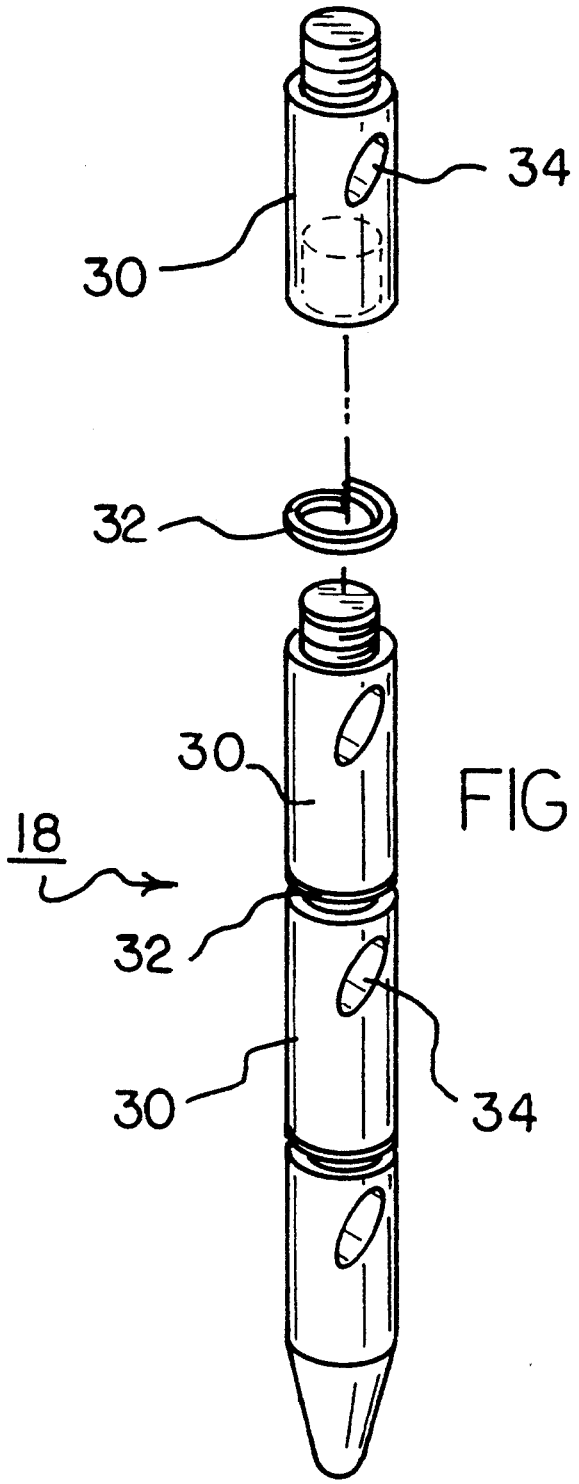
FIG. 5 is an exploded perspective view of several of the segments of the pin shown in FIG. 4.

The FIG. 3 embodiment differs from that of FIGS. 1 and 2 in that it eliminates the elastomeric coating on the plates. In place thereof, the elastomeric material is in the form of an elastomeric sheet 38 between adjacent plates 12. Holes 40 and 42 extend therethrough and correspond in size and location to the vertical holes 24 and 26 through the plates 12.

Figure 6:
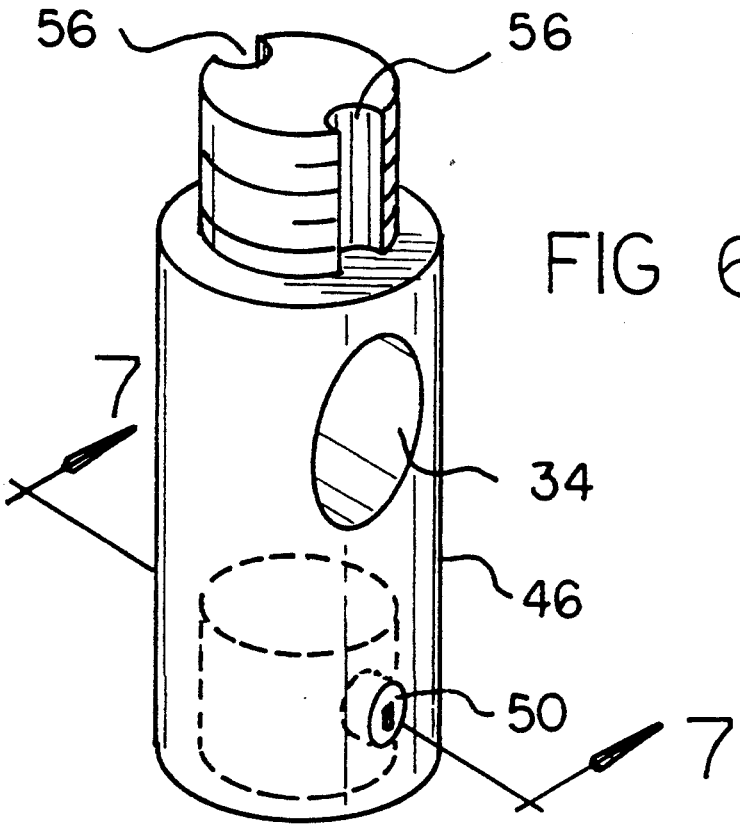
FIG. 6 illustrates one segment of a pin of the prior Figures illustrating an alternate embodiment of the invention.
Figure 7:
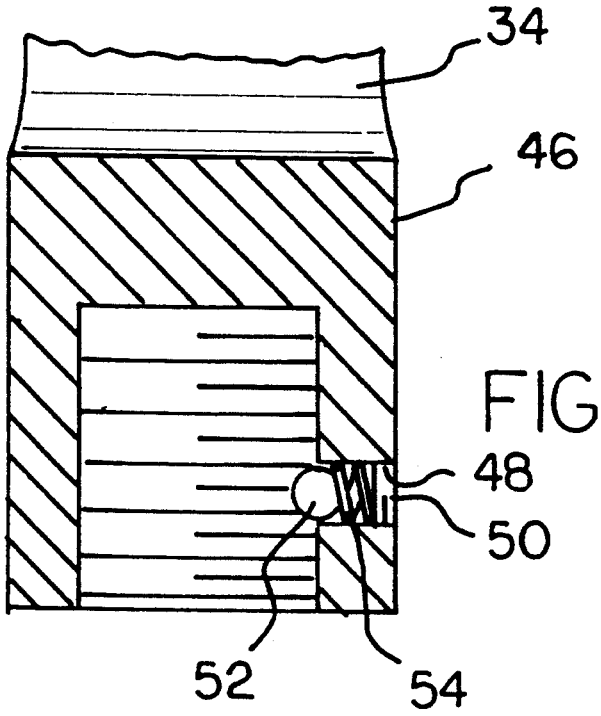
FIG. 7 is a sectional view taken through line 7—7 of FIG. 6.

FIGS. 6 and 7 illustrate a third embodiment of the invention. According to such embodiment, the segments 46 of the pin further include a threaded radially disposed aperture 48 with a set screw 50 threaded therein. The set screw 50 is adapted to hold a ball 52 with a biasing spring 54 between the ball and set screw. These components function to contact and an axial recess 56 in each pin segment. This acts to rotationally position the holes 34 in parallel aligned relationship one to another. This embodiment allows removal of washers 32.

The concept for the present invention originated because of excessive noise and unneeded stress on weight stacks which also causes unwanted cracks and breaks in the weight stack plates. The concept has three phases. The initial phase of the development included custom designed springs for the bottom of the weight stack with a rubber solution coating. In order to prevent the weights from hitting the bottom of the machine frame, causing stress fractures, a rubber coating on the springs reduced the noise level of the spring. This phase also included dipping, spraying, or brushing of all weight stack plates with a rubber solution therefore protecting the plates from clanging together. This also protected them from cracking and reduced noise. The rubber solution is available in a variety of colors.

Due to thickness of the rubber solution a special pin rod was required to accommodate the variation in height of the weight stack. A telescoping pin may also be utilized on top of the pin to reduce slack in the cable thereabove.

The next phase in the development of the invention included all of the previous modifications except for the use of the rubber solution coating surrounding the weight stack plates. This included the placing of rubber spacers between each weight stack plate. Each piece of rubber has an adhesive backing to adhere to each weight stack plate that is placed against it.

The final phase of the development of the invention involved a pin rod which is an interchangeable rod, the length of which is determined by the number of plates on the weight stack. This feature also allows the user to lengthen or shorten the pin rod depending on the amount of weight being used. The pin rod also allows the user to vary the size between hole to hole on the pin rod. This will allow the user to vary the thickness of the material that will be used between each plate to soundproof the equipment to their own likeness. The pin rod will adjust between holes from 1/16 inch to ¼ inch and uses locking washers to secure tightness of the bar between hole to hole. The pin rod is turned counterclockwise to increase the size between two holes. One full turn equals 1/16".

Sound proofing is a very serious concept. The sound proofing of weight equipment is important in hospitals, and physical therapy clinic atmospheres as well as gymnasiums. Gymnasiums will benefit more from the rubber coating as a protection from stress fractures.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A system for abating noise associated with the use of weight stack plates comprising:

a stack of plates for a weight lifting machine, each plate having a central vertical hole therethrough and supplemental guide holds therethrough and a horizontal hole from one edge to the center vertical hole perpendicular to the central vertical hole;

elastomeric material operatively associated with at least the upper and lower surfaces of the plates of the stack to abate noise normally associated with the movement of the plates; and a pin positioned vertically through the center holes of the plates of the stack, the pin being formed of a plurality of axially aligned segments coupleable one to another, along a common axis with spacers associated with each segment corresponding to the thickness of the elastomeric material between adjacent plates, the pin being formed to have a horizontal hole in each segment aligned with the horizontal holes of the plates.

2. The system as set forth in claim 1 wherein the elastomeric material is formed of constitutes a coating of a resilient noise abating material adhered to each plate.

3. The system as set forth in claim 1 wherein the elastomeric material is in the form of an elastomeric sheet between adjacent plates with holes therethrough corresponding to the vertical holes through the plates.

4. The apparatus as set forth in claim 1 wherein the spacers are washers of a thickness corresponding to the thickness of the elastomeric material between adjacent plates.

5. The apparatus as set forth in claim 1 wherein the spacers include a threaded aperture in each segment of the pin with a set screw and spring used ball adapted to rotationally positioned the holes through the segments of the pin in parallel alignment with respect to one another.

6. A system for abating the noise normally associated with the use of weight stack plates comprising, in combination:

a stack of plates for a weight lifting machine, each plate having a central vertical hole therethrough and supplemental guide holds therethrough and a horizontal hole from one edge to the center vertical hole perpendicular to the central vertical hole for use in determining the number of plates to be lifted in a group;

a coil spring with a coating of elastomeric material to abate noise normally associated with the movement of the spring and weight stack plates, the spring being located beneath the lower most plate of the stack;

elastomeric means on at least the upper and lower surfaces of the plates of the stack to be lifted to abate noise normally associated with the movement of the plates;

a pin positioned vertically through the center holes of the plates of the stack, the pin being formed of a plurality of axially aligned segments coupleable one to another along a common axis alignment with a washer between each segment corresponding to the thickness of the elastomeric means between adjacent plates, the pin being formed to have a horizontal hole in each segment aligned with the horizontal holes of the plates; and a coupling member positionable through a predetermined horizontal hole in the pin and through an associated horizontal hole of a plate of the stack to determine which plates of the stack are to be lifted as a group.

* * * * *